US005239344A

United States Patent [19]

Enoki et al.

[11] Patent Number: 5,239,344

[45] Date of Patent: Aug. 24, 1993

[54] DEVELOPING ROLLER HAVING INSULATING AND CONDUCTIVE AREAS

[75] Inventors: Shigekazu Enoki, Kawasaki; Naoki Iwata, Tokyo; Koji Suzuki, Yokohama; Yuichi Ueno, Kawasaki; Junko Tomita, Tokyo, all of Japan

[73] Assignee: Ricoh Company, Ltd., Tokyo, Japan

[21] Appl. No.: 753,234

[22] Filed: Aug. 30, 1991

[30] Foreign Application Priority Data

Jan. 16, 1991 [JP] Japan ..... 3-015778

[51] Int. Cl.[5] ..... G03G 15/06

[52] U.S. Cl. ..... 355/259; 118/651

[58] Field of Search ..... 355/245, 259, 261, 262; 118/648, 651

[56] References Cited

U.S. PATENT DOCUMENTS

| | | | |
|---|---|---|---|
| 3,203,394 | 8/1965 | Hope et al. | 355/259 X |
| 3,759,222 | 9/1973 | Maksymiak et al. | 355/259 X |
| 3,865,080 | 2/1975 | Hudsun | 118/637 |
| 4,114,261 | 9/1978 | Weiler | 355/265 X |
| 4,289,837 | 9/1981 | Gundlach | 118/651 X |
| 4,395,476 | 7/1983 | Kanbe et al. . | |
| 4,515,106 | 5/1985 | Kohyama | 118/651 |
| 4,564,285 | 1/1986 | Yasuda et al. | 118/651 X |
| 4,576,463 | 3/1986 | Sakamoto et al. . | |
| 4,656,964 | 4/1987 | Kanno et al. | 118/651 X |
| 4,696,255 | 9/1987 | Yano et al. | 355/259 X |
| 4,788,570 | 11/1988 | Ogata et al. | 355/245 |
| 4,806,992 | 2/1989 | Yasuda et al. | 118/651 X |
| 4,873,940 | 10/1989 | Ishikawa et al. | 118/651 |
| 4,930,438 | 6/1990 | Demizu et al. | 118/651 |
| 4,982,692 | 1/1991 | Uematsu | 118/651 |

FOREIGN PATENT DOCUMENTS

| | | |
|---|---|---|
| 4032469 | 4/1991 | Fed. Rep. of Germany . |
| 2237407 | 5/1991 | United Kingdom . |

OTHER PUBLICATIONS

Society of Photographic Scientists and Engineers, Oct. 1973, pp. 62–65, P. G. Andrus et al., "Microfield Donors for Touchdown Development".

*Primary Examiner*—A. T. Grimley
*Assistant Examiner*—Nestor R. Ramirez
*Attorney, Agent, or Firm*—Oblon, Spivak, McClelland, Maier & Neustadt

[57] ABSTRACT

A method and apparatus for developing a latent image electrostatically formed on an image carrier by a developer carried on a developer carrier in a developing region where the image carrier and the developer carrier are located face-to-face. A great number of electric fields are produced on the surface of the developer carrier. An electric field is produced by a voltage applying device in the developing region. The movement of the developer is controlled by an electric field determined by the relationship between a potential deposited on the image carrier, a potential deposited on the developer carrier, and the electric field produced by the voltage applying device. A large number of first and second areas are formed on the surface of the developer carrier such that the first areas are charged to a predetermined potential and the second areas as set at a potential which is lower than the predetermined potential of the first areas in order to generate different level electric fields in the first and second areas. With this arrangement, higher quality images having constant density are formed as a well-balanced charging/discharging condition is developed between the toner and the toner supply roller of the device.

28 Claims, 11 Drawing Sheets

DEVELOPING ROLLER HAVING INSULATING AND CONDUCTIVE AREAS

BACKGROUND OF THE INVENTION

The present invention relates to a developing method and an apparatus therefor which is incorporated in an electrophotographic copier, printer, facsimile transceiver or similar image forming equipment. More particularly, the present invention is concerned with a method of developing a latent image electrostatically formed on an image carrier in a developing region by a developer carried on a developer carrier which faces the image carrier in the developing region, and an apparatus therefor.

With the above-described kind of image forming equipment, it has been customary to locate a developer carrier carrying a thin layer of developer thereon and an image carrier carrying an electrostatic latent image thereon face-to-face in a developing region. An electric field capable of transferring the developer from the developer carrier to the image carrier is generated in the developing region to thereby develop the latent image on the image carrier. This type of developing method has a threshold regarding the transfer of the developer from the developer carrier to the image carrier. The problem is, therefore, that although the developer deposits in an image portion having a surface potential higher than the threshold, it scarcely deposits in an image portion whose surface potential is lower than the threshold, resulting in an image whose tones are poor.

The above problem can be eliminated if an alternating electric field of relatively low frequency is generated in the developing region, as proposed in the past (see, for example, Japanese Patent Publication No. 1013/1989). Such a scheme, however, has a disadvantage that conditioning the alternating electric field for the enhancement of tones causes the image density to decrease while conditioning it for the enhancement of image density causes line images to become thicker.

Another problem with the above-described type of developing method is that when use is made of a non-magnetic toner as a developer, it changes into a powder cloud when caused to move in a reciprocating motion, noticeably lowering the image density (see, for example, Japanese Patent Publication No. 14706/1990).

Today, the demand for higher image quality is increasing in parallel with the diversification of the output information of images to be formed by image forming equipment. To meet this demand, various kinds of developing methods have recently been developed for improving image density while preserving tones, and preventing line images from thickening to thereby implement high quality images.

SUMMARY OF THE INVENTION

It is, therefore, an object of the present invention to provide a developing method capable of enhancing image density while preserving tones and preventing line images from thickening to thereby produce high quality images, and an apparatus therefor.

It is another object of the present invention to provide a generally improved developing method and an apparatus therefor.

In accordance with the present invention, a developing apparatus incorporated in image forming equipment and located to face an image carrier in a developing region for developing a latent image electrostatically formed on the image carrier by a developer has a developer carrier for carrying the developer thereon and developing the latent image formed on the image carrier by the developer in the developing region. A great number of electric fields are arranged on the surface of the developer carrier. A voltage source produces an electric field in the developing region. The developing apparatus controls the movement of the developer from the developer carrier to the image carrier by an electric field which is determined by the relationships between a potential deposited on the image carrier, a potential deposited on the developer carrier, and the electric field produced by the voltage source.

Also, in accordance with the present invention, a method of developing a latent image electrostatically formed on an image carrier by a developer carried on a developer carrier in a developing region where the image carrier and developer carrier face each other comprises the steps of forming on the surface of the developer carrier first areas which hold a charge and are charged to a predetermined potential, and second areas lower in potential than the first areas, producing an electric field in the developing region by a voltage source, and producing in the first areas an electric field for development which is different from an electric field in the second areas by the charge held by the first areas, a potential deposited on the image carrier, and the electric field produced by the voltage source.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
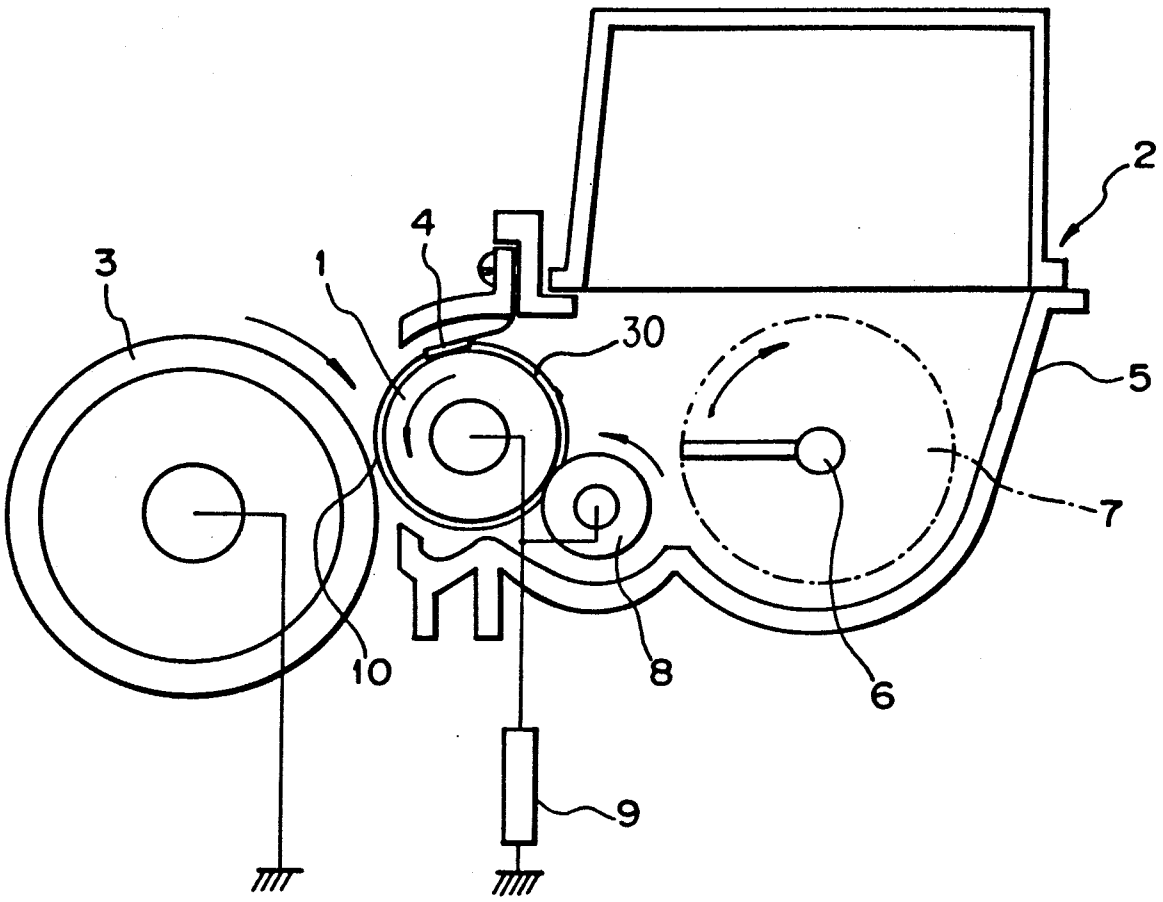
FIG. 1 is a sectional side elevation showing a developing apparatus with which the present invention is practicable.
Figure 1A:
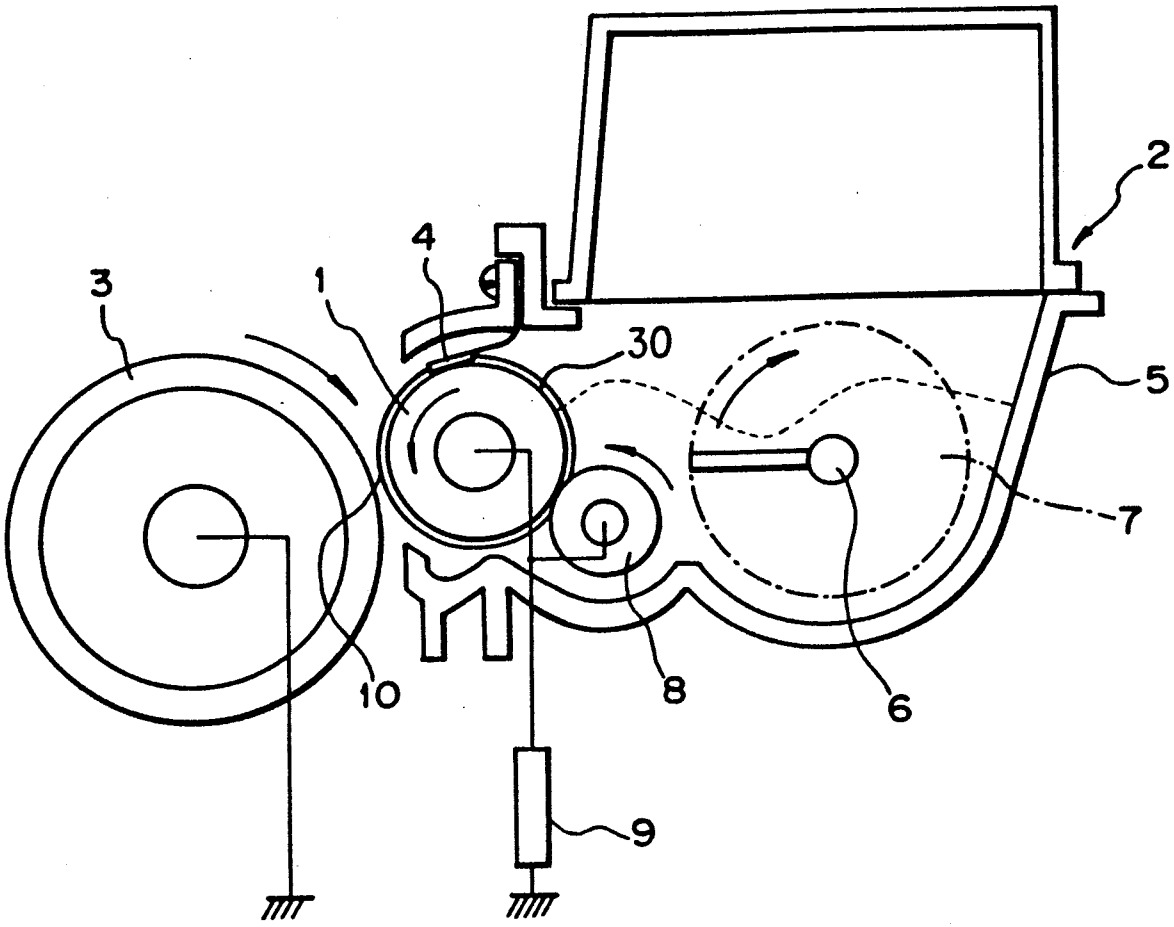
FIG. 1A shows the sectional side elevation of FIG. 1 with a gap between the developing roller and the photoconductive drum being smaller than the thickness of the developer deposited on the developer carrier.

Referring to FIG. 1 of the drawings, a developing apparatus for practicing the present invention is shown and generally designated by the reference numeral 1. As shown, the apparatus 2 has a casing in which a developing roller 1 is rotatably disposed. The developing roller 1 is spaced apart from a photoconductive drum 3 by a predetermined gap 10 and faces it through an opening formed in the casing. A blade 4 is resiliently pressed against the periphery of the developing roller 1 so as to regulate the thickness of a toner layer which is transported by the roller 1. As shown in FIG. 1, the gap 10 formed between the developing roller 1 and the photoconductive drum 3 is greater than the thickness of the layer 30 of developer which has been deposited on roller 1. FIG. 1A, on the other hand, shows an embodiment where the gap 10 is smaller than the thickness of the layer 30 of developer deposited on the developer roller 1. Specifically, the blade 4 regulates the thickness of a toner 7 which is fed to the roller 1 from a toner tank 5 by an agitator 6 and a toner supply roller 8. The toner tank 5 is defined in the casing of the apparatus 2. The blade 4 may be replaced with a roller or a belt, if desired. Rotating clockwise, as indicated by an arrow in the figure, the agitator 6 agitates the toner 7 and moves it to the left in the figure. The toner supply roller 8 is implemented as a sponge of foam urethane rubber or a brush constituted by the filaments of polyester, tetrafluoroethylene or a similar substance. The toner supply roller 8 rubs the toner 7 having been fed thereto by the agitator 6 against the surface of the developing roller 1 in the forward or reverse direction, thereby supplying the toner 7 to the roller 1. At the same time, the supply roller 8 scrapes off the toner 7 which is left on the developing roller 1 without being used for development.

The toner 7 transferred from the toner supply roller 8 to the developing roller 1 is electrostatically deposited on the surface of the roller 1 since the toner 7 is charged by the friction thereof with the roller 8 or the roller 1. The toner 7 is transported by the developing roller 1 to a developing region where the roller 1 faces the drum 3, while being regulated in thickness by the blade 4. The blade 4 may be implemented by a leaf spring with rubber or similar material capable of charging the toner 7 adhered thereto or by a resilient member only. The blade 4 may be located in the trailing direction as shown in the figure or in the leading direction with respect to the direction of rotation of the developing roller 1, as desired.

Bias applying means 9 is connected to the developing roller 1 and toner supply roller 8. The bias applying means 9 may be connected to the blade 4, if desired. To develop a latent image electrostatically formed on the drum 3, a particular amount of toner 7 matching the latent image is transferred from the developing roller 1 to the latent image with a bias voltage being applied to the roller 1. The developing roller 1 is spaced apart from the drum 3 by 30 μm to 500 μm, preferably 50 μm to 250 μm. This eliminates an excessive load which would be needed if the developing roller 1 were held in contact with the drum 3 for development, allowing the apparatus 2 to operate with a miniature drive motor. To further reduce the drive torque, the drum 3 and developing roller 1 may be rotated at substantially the same peripheral speed. Regarding the bias to be applied by the bias applying means 9, use may be made of a combination of DC and AC electric fields. The AC electric field may preferably be implemented as a pulse field in the form of a rectangular wave whose frequency is as low as 300 Hz to 2,000 Hz, preferably 500 Hz to 1,500 Hz. In such a rectangular wave, the high voltage portion and the low voltage portion each preferably has a different ratio to one cycle with respect to duration. Then, a desirable image is achievable which has sharpness in the low voltage portion and high density in the high voltage portion and suffers from a minimum amount of contamination in the background thereof. The ratio in duration between the high voltage portion and the low voltage portion (referred to as a duty ratio hereinafter) depends on the polarity of the latent image and that of the toner 7. For example, assuming that a negatively charged latent image is developed by a negatively charged toner 7 by reversal, the ratio between the high voltage portion (higher than −100V) and the low voltage potion (lower than −800V) may be selected to be 5-18:2-8. In the case of regular development, a quality image having the above-mentioned features is also achievable if such a ratio is inverted.

Figure 2A:
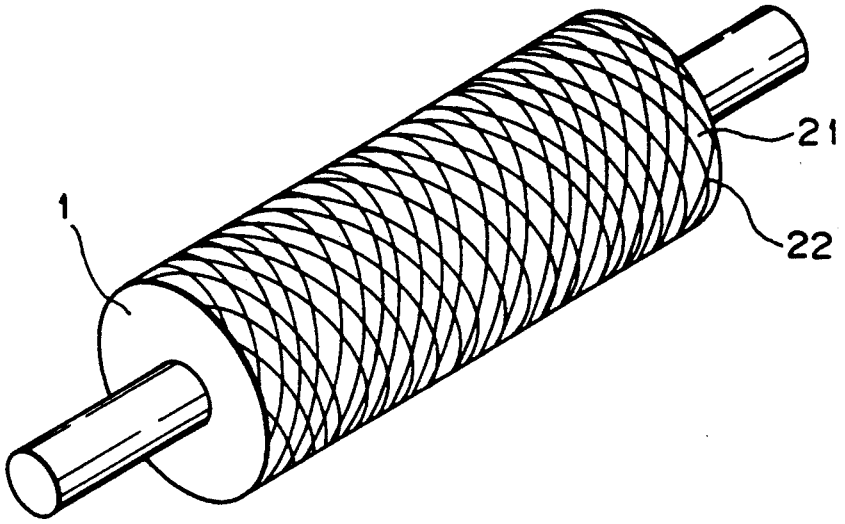
FIG. 2A is a perspective view showing a specific configuration of a developing roller included in the developing apparatus.
Figure 2B:
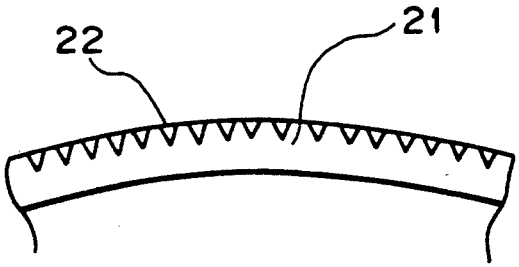
FIG. 2B is a fragmentary enlarged section of the developing roller shown in FIG. 2A.

In the illustrative embodiment, the surface of the developing roller 1 is minutely divided into conductive areas and insulating areas. FIG. 2A shows a specific configuration of such a surface of the developing roller 1 while FIG. 2B shows part of the surface configuration in an enlarged section. The developing roller 1 is made up of a plurality of substances each having a particular resistance or dielectric constant. Specifically, in the configuration shown in FIGS. 2A and 2B, the roller 1 is made of metal such as aluminum, conductive rubber, conductive plastic or similar substance and has the surface thereof knurled in a mesh pattern. Polycarbonate, acryl, polyester, tetrafluoroethylene or similar dielectric resin is filled in the recesses formed by knurling in the surface of the roller 1. As a result, the surface of the roller 1 is constituted by insulating areas 22 in a mesh pattern and minute conductive areas 21 adjoining the insulating areas 22.

It should be noted that knurling used to form the two different kinds of areas 21 and 22 is not limitative and may be replaced with any other suitable technology.

The insulating areas 22 have a mean diameter of 30 μm to 2,000 μm, preferably 50 μm to 1,000 μm. When the insulating areas 22 are circular, for example, they are provided with a diameter D1 (see FIG. 3) of 30 μm to 2,000 μm, preferably 100 μm to 400 μm, and have their centers spaced apart by an adequate distance P1 (see FIG. 3). When the insulating areas 22 are rectangular, their shortest side is selected to be 30 μm to 2,000 μm. Further, when the insulating areas 22 are oblong, the are provided with a 30 μm to 2,000 μm wide shorter axis. This is also true for any other shape of the insulating areas 22. The insulating areas 22 occupy 50% to 80%, preferably 65% to 75%, of the entire surface of the roller 1. Such a configuration of the developing roller 1 allows the toner 7 to be charged by the friction when rubbed against the roller 1 by the toner supply roller 8, thereby depositing a sufficient amount of toner 7 on the roller 1.

Figure 3:
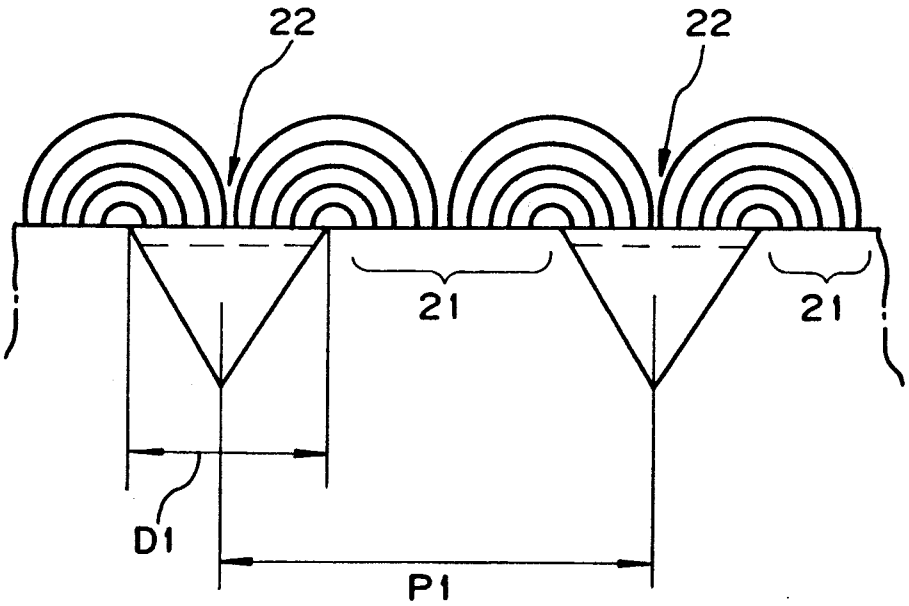
FIG. 3 shows electric lines of force representative of microfields which are developed in close proximity to insulating areas.

In detail, the insulating areas 22 of the developing roller 1 are charged by the friction thereof with the toner supply roller 8 to positive polarity which is opposite to the charge polarity of the toner 7. On the other hand, the toner 7 being conveyed toward the developing roller 1 in contact with the toner supply roller 8 is negatively charged by friction. On reaching the developing roller 1, the toner 7 is further charged to negative polarity due to the friction thereof with the roller 1, especially the insulating areas 22, and thereby electrostatically adhered to the periphery of the roller 1. At this instant, the insulating areas 22 of the developing roller 1 have been positively charged by friction. This coupled with the fact that the conductive areas 21 adjoin the insulating areas 22, caused positive polarity to be applied only to the numerous insulating areas 22 of the developing roller 1. As a result, as shown in FIG. 3, closed electric fields are produced between the positively charged insulating areas 22 and the associated conductive areas 21, whereby a great number of microfields are formed in the vicinity of the roller surface. More specifically, in the space adjoining the developing roller 1, electric lines of force extending out from and returning to the roller 1, as represented by arcs in FIG. 3, are formed to generate microfields between the two kinds of areas 22 and 21 of the roller 1.

Each of the microfields has a considerable intensity due to the fringing effect which is derived from such a small area of each insulating area 22. The toner 7 negatively charged by the microfields is strongly attracted by the insulating areas 22 of the developing roller 1 and firmly retained on the latter. Moreover, when the blade 4 regulates the thickness of the toner 7 on the developing roller 1, the toner particles 7 with a small amount of charge are removed from the roller 1 by the blade 4 although the toner particles 7 with a sufficient amount of charge are firmly retained on the roller 1 by the microfields. Consequently, only the toner particles 7 with a sufficient amount of charge such as 5 μC/g to 20 μC/g (preferably 10 μC/g to 15 μC/g) are transported to the gap 10 between the roller 1 and the drum 3. In the embodiment, since the conductive areas 21 and insulating areas 22 exist together on the surface of the developing roller 1, the charge-up of the rollers 1 and 8 is eliminated. Presumably, this is because the insulating areas 22 charge the toner 7 while the conductive areas 21 discharge the toner supply roller 8, setting up a well-balanced charge condition as a whole.

It is considered that the rectangular pulse field applied as a developing bias acts on the microfields developed between the two different kinds of areas 21 and 22 of the developing roller 1 and on the charged toner to produce mechanical energy which is suitable for the development of a latent image.

More specific embodiments of the present invention will be described hereinafter.

Figure 4A:
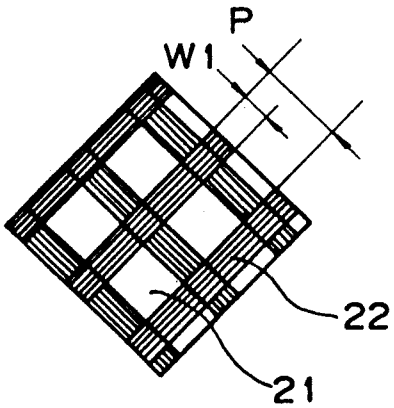
FIGS. 4A through 4C each shows a specific surface configuration of the developing roller which has insulating areas of particular width.
Figure 4B:
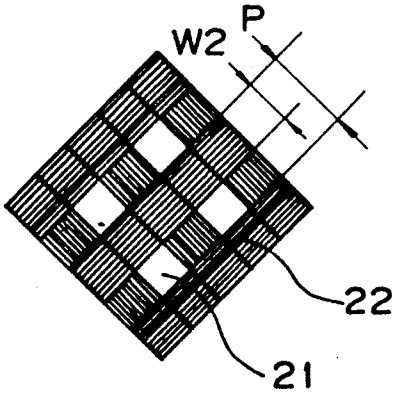
Figure 4C:
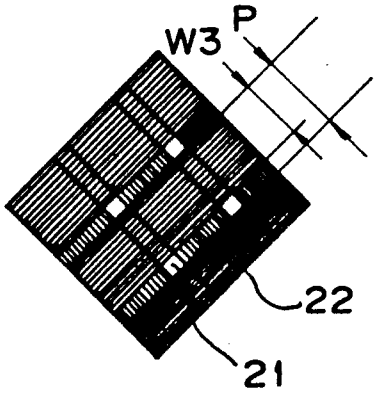

FIGS. 4A through 4C each shows a specific arrangement of the conductive areas 21 and insulating areas 22 provided on the knurled surface of the developing roller 1. The recesses formed by knurling have a pitch P of 0.3 mm and a width W1 of 0.075 mm, a width W2 of 0.15 mm or a width W3 of 0.225 mm. The embodiments which will be described use such developing rollers 1.

In a first embodiment, the photoconductive drum 3 is implemented by OPC and has a surface potential of −900V in the background and a potential of −100V in the exposed area. The developing roller 1 with the configuration shown in FIG. 4B is located to face the drum 3 at a distance of 100 μm to effect reversal development. The insulating areas 22 of the roller 1 were found to hold an amount of charge corresponding to a potential of +200V with the ground level as a reference by being rubbed by the toner supply roller 8. A negatively charged toner 7 was deposited on such a roller 1 in an amount of about 1.0 mg/cm$^2$ to 1.2 mg/cm$^2$. The bias applying means 9 applies to the roller 1 a pulse voltage of 1,000V (peak-to-peak or P-P) and having the maximum potential of 0V, frequency of 500 Hz, and duty ratio of 30% ($T_2/T_1$).

Figure 5A:
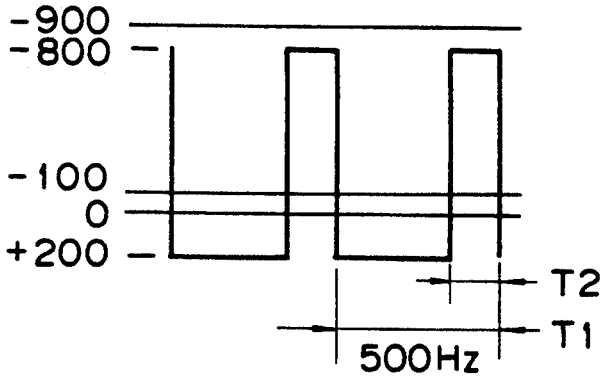
FIG. 5A is a diagram indicative of the variation of the surface potential of the developing roller with respect to time particular to a first embodiment of the present invention and associated with insulating areas.
Figure 5B:
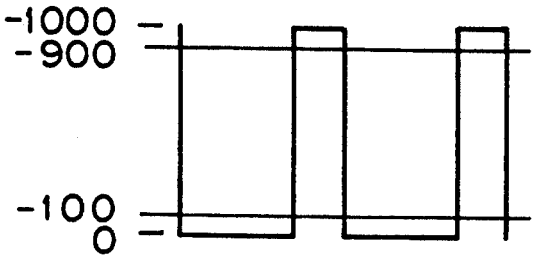
FIG. 5B is a diagram similar to FIG. 5A, showing a variation associated with conductive areas.

FIGS. 5A and 5B show respectively the variations of the surface potential of the developing roller 1, with the ground level as a reference, which were determined with the insulating areas 22 and the conductive areas 21. In the figures, the surface potential (−900V) of the background of the drum 3 and the surface potential (−100V) of the exposed area of the same are indicated by horizontal lines, while the variations of the surface potential of the developing roller 1 with respect to time are indicated by continuous rectangular lines. As the rectangular line of FIG. 5A indicates, the surface potential of the insulating areas 22 is offset by +200V in terms of the charge held by the voltage from the bias applying means 9. On the other hand, as shown in FIG. 5B, the surface potential of the conductive areas 21 is identical with the voltage from the bias applying means 9.

Figure 6A:
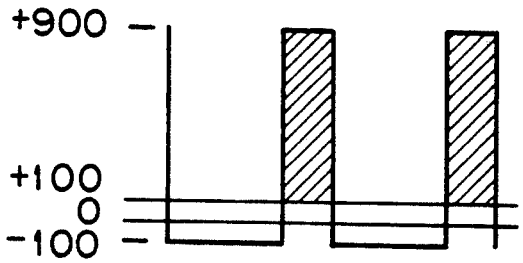
FIG. 6A is a diagram representative of the variation of an electric field for development formed on the conductive areas of the first embodiment and occurring when the conductive areas face the image area of a photoconductive drum.
Figure 6B:
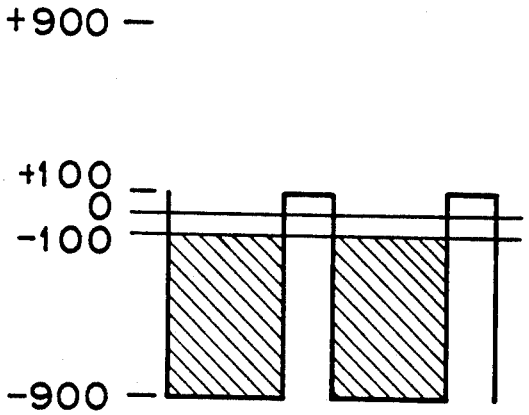
FIG. 6B is a diagram similar to FIG. 6A, showing a variation occurring when the conductive areas face the background of the drum.
Figure 7A:
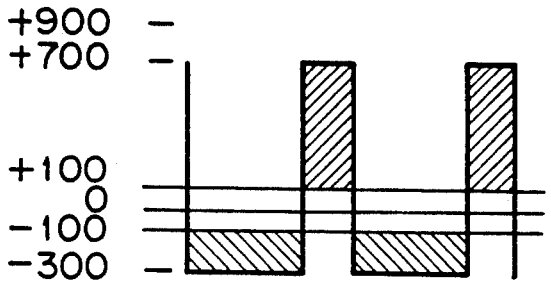
FIG. 7A is a diagram representative of the variation of an electric field for development formed on the insulating areas of the first embodiment and occurring when the insulating areas face the image area of the drum.
Figure 7B:
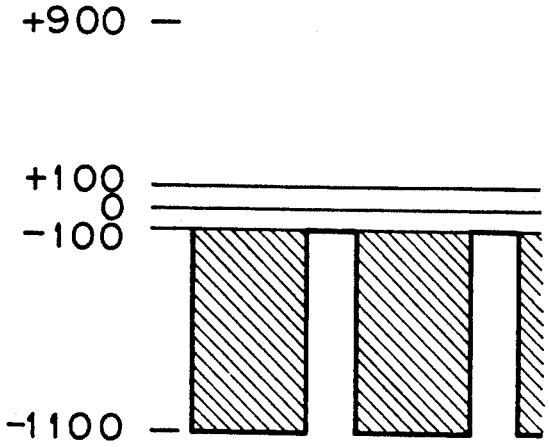
FIG. 7B is a diagram similar to FIG. 7A, showing a variation occurring when the insulating areas face the background of the drum.

Hereinafter will be described the electric field which is developed between the developing roller 1 and the drum 3 when the surface potential of the roller 1 changes. This electric field differs from the insulating areas 22 to the conductive areas 21 of the roller 1 and from the image area to the background of the drum 3 which the areas 21 and 22 will face. FIGS. 6A and 6B each shows the electric field on the conductive areas 21 which causes the surface potential to vary in the manner shown in FIG. 5B. Specifically, FIG. 6A indicates the variation of the potential difference between the conductive areas 21 and the image area (exposed area) of the drum 3 occurring when the former faces the latter. FIG. 6B shows the variation of the same occurring when the conductive areas 21 face the non-image area (unexposed area) of the drum 3. Further, FIGS. 7A and 7B indicate the electric field on the insulating areas 22 which causes the surface potential to vary in the manner shown in FIG. 5A. FIGS. 7A and 7B represent respectively a condition wherein the insulating areas 22 face the image area (exposed area) of the drum 3 and a condition wherein the former faces the non-image area (unexposed area) of the latter. Here, the electric field exerts an electrostatic force on the toner 7 deposited on the developing roller 1 or the toner 7 deposited on the drum 3. For this reason, the above-mentioned potential difference corresponding to the electric field of the direction in which the toner 7 moves toward the drum 3 and the potential difference corresponding to the electric field of the direction in which it moves toward the roller 1 are respectively represented by the positive sign and the negative sign in order to distinguish the directions of the electrostatic force. Horizontal lines are representative of the level of a threshold of +100V of the potential difference which causes the toner 7 on the roller 1 to move toward the drum 3 and the level of a threshold of −100V which causes the toner 7 on the drum 3 to move toward the roller 1. The portions corresponding to the electric fields which contribute to the transfer of the toner 7 beyond the thresholds are indicated by hatching.

It is to be noted that the above-stated variations were determined when the gap 10 between the roller 1 and the drum 3 was 100 μm and a DC voltage was applied to the roller 1 and sequentially changed. With this embodiment, the threshold of the electric field for development was found to be 1V/μm. In such a condition, the amount of charge deposited on the toner 7 was about 10 μC/g.

Presumably, when the conductive areas 21 of the roller 1 face the image area of the drum 3, the toner 7 deposited on the areas 21 moves toward the drum 3 when an electric field for development corresponding to the potential difference of +900V is set up, as indicated by hatching in FIG. 6A. When the conductive areas 21 face the background of the drum 3, the toner 7 presumably moves toward the roller 1 when an electric field of −900V is set up, as indicated by hatching in FIG. 6B. Regarding the toner 7 deposited on the insulating areas 22 of the roller 1, since the areas 22 are originally charged to +200V, a negative field of −300V and a positive field of +700V appear alternately when the areas 22 face the image area of the drum 3, as indicated by hatching in FIG. 7A. Therefore, the toner 7 in the areas 22 presumably moves toward the drum 3 when the field is positive or toward the roller 1 when the field is negative. When the areas 22 face the background of the drum 3, it is considered that the toner 7 moves from the drum 3 toward the roller 1 when a fluid of −1,100V is set up, as indicated by hatching in FIG. 7B, and does not move toward the drum 3 and roller 1 alternately.

As stated above, the transfer of the toner 7 carried on the developing roller 1 is selectively controlled by the electric field produced on the developing roller. An image produced by the above arrangement was compared with an image produced by a developing roller with an aluminum surface and, therefore, by the electric fields shown in FIGS. 6A and 6B. The comparison showed that the embodiment is successful in producing an image which is high in density and free from contamination in the background thereof and in reproducing even line images desirably. The developing roller with an aluminum surface could not reproduce line images as desirably as the embodiment without reducing the image density.

In the illustrative embodiment, the surface of the developing roller 1 has particular areas on which a different bias for development acts. Hence, when a bias is applied between the drum 3 carrying a latent image and the developing roller 1 carrying the toner, the toner transfer can be selectively controlled by the developing roller 1 whose surface is selectively charged. This is presumably why the above-stated advantages are achievable. Specifically, positive and negative electric fields each exceeding a threshold as shown in FIG. 7A act on the toner 7 which is present in the insulating areas 22, preventing the toner 7 from being deposited in an excessive amount. On the other hand, the toner 7 existing in the conductive areas 21 has a higher developing ability than the toner 7 existing in the insulating areas 22. In addition, the conductive areas 21 serve to suppress the edge effect and thereby sets up a uniform density distribution.

It will be seen that the illustrative embodiment attains the advantages particular to a developing roller with an insulating surface and advantages particular to a developing roller with a conductive surface at the same time. A developing roller with an insulating surface reproduces line images desirably and renders tones faithfully although the image density available therewith is relatively low, but the reproducibility of line images and that of tones are degraded as the density is increased. A developing roller with a conductive surface produces an image having a high and uniform image density distribution, but it is lower in the reproducibility of line images and that of tones than the roller with an insulating surface.

When the gap 10 between the developing roller 1 and the drum 3 was increased to 200 μm, the transfer of the toner 7 was found to occur when the electric field for development exceeded 200V, meaning that the threshold of electric field was also 1V/μm. When the gap 10 was further increased with the bias voltage sequentially changed, an image was produced up to a gap of about 500 μm. Nevertheless, the gap 10 should preferably be smaller than 300 μm so that the image may have acceptable quality. Further, the gap 10 of 300 μm caused a leak to occur between the roller 1 and the drum 3 when a pulse voltae of P-P 4,500V was applied. The electric field, therefore, should be lower than 15V/μm.

To prevent the pattern of the conductive areas 21 from appearing in a reproduced image, the developing roller 1 whose insulating areas 22 have a comparatively small width W, e.g., the roller 1 shown in FIG. 4A may be moved at a higher speed than the drum 3. When the width of the insulating areas 22 is greater than the width of the conductive areas 21, it suffices to move the roller 1 at substantially the same or slightly higher speed than the drum 3. In any case, a good result is achieved when the roller 1 is moved at a 1.0 to 2.0 times, preferably 1.0 to 1.2 times, higher speed than the drum 3.

A second embodiment of the present invention will be describe hereinafter.

This embodiment also uses an OPC drum 3 and selects a surface potential of −10V and a surface potential of −850V for the background and the image area, respectively. The developing roller 1 with the surface configuration shown in FIG. 4B is spaced apart from the drum 3 by a gap 10 of 100 μm. The insulating areas 22 of the roller 1 rubbed by the toner supply roller 8 was found to hold a charge corresponding to a potential of −200V with the ground level as a reference. A positively charged toner 7 was deposited on such a developing roller 1. The amount of charge deposited on the toner 7 was measured to be 10 μC/g. The bias applying means 9 applied to the roller 1 sinusoidal AC of P-P 750V whose maximum potential was offset to +200V and having a frequency of 500 Hz.

Figure 8A:
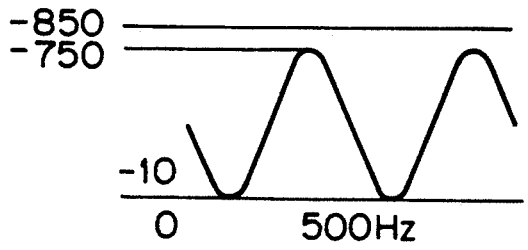
FIG. 8A is a diagram representative of the variation of the surface potential of the developing roller which is included in a second embodiment of the present invention and associated with the insulating areas.
Figure 8B:
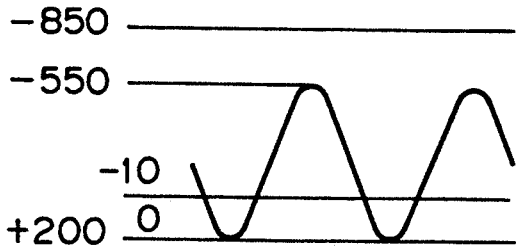
FIG. 8B is a diagram similar to FIG. 8A, showing a variation associated with the conductive areas of the second embodiment.

FIGS. 8A and 8B, like FIGS. 5A and 5B of the first embodiment, show the variation of the surface potential of the developing roller 1 with respect to time, the reference being the ground level. FIGS. 8A and 8B are associated with the surface potentials of the insulating areas 22 and conductive areas, respectively. In the figures the level (−10V) of the surface potential of the background on the drum 3 and the level (−850V) of the surface potential of the image area are represented by horizontal lines. As the sinusoidal continuous line of FIG. 8A indicates, the surface potential of the insulating areas 22 is offset by −200V due to the voltage applied by the bias applying means 9. On the other hand, as shown in FIG. 8B, the surface potential of the conductive areas 21 is identical with the voltage applied by the bias applying means 9.

Figure 9A:
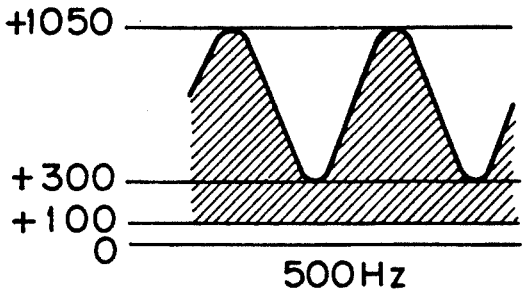
FIG. 9A is a diagram representative of the variation of an electric field for development formed on the conductive areas of the second embodiment and occurring when the conductive areas face the image area of a photoconductive drum.
Figure 9B:
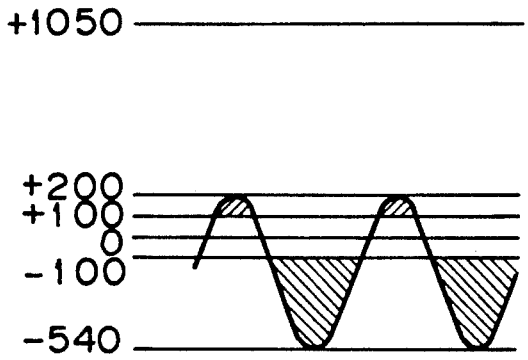
FIG. 9B is a diagram similar to FIG. 9A, showing a variation occurring when the conductive areas face the background of the drum.
Figure 10A:
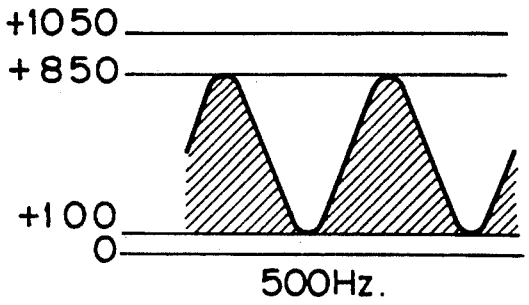
FIG. 10A is a diagram representative of the variation of an electric field for development formed on the insulating areas of the second embodiment and occurring when the insulating areas face the image area of the drum.
Figure 10B:
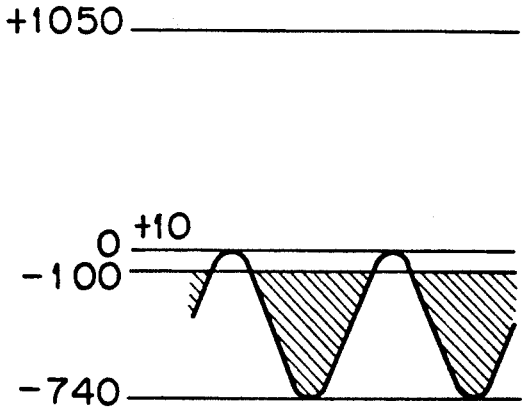
FIG. 10B is a diagram similar to FIG. 10A, showing a variation occurring when the insulating areas face the background of the drum.

Hereinafter will be described the electric field which is developed between the developing roller 1 and the drum 3 when the surface potential of the roller 1 changes. This electric field differs from the insulating areas 22 to the conductive areas 21 of the roller 1 and from the image area to the background of the drum 3 which the areas 21 and 22 will face, as in the first embodiment. FIGS. 9A and 9B each shows the electric field on the conductive areas 21 which causes the surface potential to vary in the manner shown in FIG. 8B. Specifically, FIG. 9A indicates the variation of the potential difference between the conductive areas 21 and the image area (unexposed area) of the drum 3 occurring when the former faces the latter. FIG. 9B shows the variation of the same occurring when the conductive areas 21 face the non-image area (exposed area) of the drum 3. Further, FIGS. 10A and 10B illustrate the electric field on the insulating areas 22 which causes the surface potential to vary in the manner shown in FIG. 8A. FIGS. 10A and 10B represent respectively a condition wherein the insulating areas 22 face the image area (exposed area) of the drum 3 and a condition wherein the former faces the non-image area (exposed area) of the latter. Here, the electric field exerts an electrostatic force on the toner 7 deposited on the developing roller 1 or the toner 7 deposited on the drum 3. For this reason, the above-mentioned potential difference corresponding to the electric field of the direction in which the toner 7 moves toward the drum 3 and the potential difference corresponding to the electric field of the direction in which it moves toward the roller 1 are respectively represented by the positive sign and the negative sign in order to distinguish the directions of the electrostatic force, as in the first embodiment. Horizontal lines are representative of the level of a threshold of +100V of the potential difference which causes the toner 7 on the roller 1 to move toward the drum 3 and the level of a threshold of −100V which causes the toner 7 on the drum 3 to move toward the roller 1, as determined by experiments as in the first embodiment. The portions corresponding to the electric fields which contribute to the transfer of the toner 7 beyond the thresholds are indicated by hatching. The threshold of the electric field for development was also found to be 1V/μm.

Presumably, when the conductive areas 21 of the roller 1 face the image area of the drum 3, the toner 7 deposited on the areas 21 moves toward the drum 3 since a positive field of +100V to +1,050V is constantly set up, as indicated by hatching in FIG. 9A. When the conductive areas 21 face the background of the drum 3, a negative field of −100V to −540V and a positive field of +100V to +210V appear alternately as electric fields that contribute to the transfer of the toner 7, as indicated by hatching in FIG. 9B. Therefore, the toner 7 in the areas 22 presumably moves toward the drum 3 when the field is positive or toward the roller 1 when the field is negative. Presumably, however, since the transfer of the toner 7 from the drum 3 to the roller 1 occurs over a sufficiently longer period of time than the transfer of the same from the roller 1 to the drum 3 and with a greater force than the latter, the toner 7 transferred to the drum 3 by the positive electric field is returned to the roller 1. Likewise, when the insulating areas 22 face the image area of the drum 3, the toner 7 existing in the areas 22 is constantly subjected to a positive field +100V to +850V, as indicated by hatching in FIG. 10A. Hence, although the toner 7 is transferred from the roller 1 to the drum 3, the transferring force is presumably smaller than the transferring force acting on the toner in the conductive areas 21 since the areas 22 are originally charged to −200V. When the insulating areas 22 face the background of the drum 3, only a negative field of −100V to −740V appears as a field that contributes to the toner transfer, as indicated by hatching in FIG. 10B. This suggests that the alternating toner transfer to the roller and the drum 3 does not occur.

As stated above, the transfer of the toner 7 deposited on the developing roller 1 is selectively controlled by the electric field produces on the roller 1.

Experiments showed that this embodiment also reproduces an image which is high in density and free from contamination in the background thereof, and that it reproduces even line images desirably, compared to a case wherein a developing roller with an aluminum surface is used and a voltage having a sinusoidal waveform is applied to the roller.

Experiments were also conducted with the developing rollers 1 having the surface configurations shown in FIGS. 4A and 4C and by applying the pulse voltage of the first embodiment or the sinusoidal AC voltage of the second embodiment. The resulted images were as fair as the image achievable with the surface configuration shown in FIG. 4B. In addition, the embodiments were found to reduce the contamination of the parts and elements surrounding the developing section by the toner 7, compared to a conventional developing roller. That is, the embodiments not only enhance the image quality but also reduce the contamination by the toner 7.

In summary, it will be seen that the present invention provides a developing method and an apparatus therefor which control the movement of a developer by the relationship between a potential deposited on an image carrier, a potential deposited on a developer carrier, and an electric field applied by voltage applying means and thereby cause an adequate amount of developer to deposit on a latent image electrostatically formed on the image carrier. This is successful in producing an image having high density and achieving desirable reproducibility of line images and tones.

Various modifications will become possible for those skilled in the art after receiving the teachings of the present disclosure without departing from the scope thereof.

What is claimed is:

1. A developing apparatus incorporated in image forming equipment and located to face an image carrier in a developing region for developing a latent image electrostatically formed on said image carrier by a developer, said apparatus comprising:

a developer carrier for carrying the developer thereon and developing the latent image formed on said image carrier by said developer in said developing region, said developer carrier having first areas comprising a plurality of recesses formed on a surface thereof, each of which holds an insulating material such that a mesh pattern is formed on the surface of the developer carrier by the plurality of recesses holding said insulating material and second areas comprising a plurality of conductive areas interposed between said recesses, and wherein a great number of electric fields are arranged on the surface of said developer carrier; and voltage applying means for producing an electric field in said developing region;

said developing apparatus controlling the movement of said developer from said developer carrier to said image carrier by an electric field which is determined by the relationships between a potential deposited on said image carrier, a potential deposited on said developer carrier, and said electric field produced by said voltage applying means.

2. An apparatus as claimed in claim 1, wherein said developer carrier carries the developer due to said great number of electric fields.

3. An apparatus as claimed in claim 1, wherein said electric field produced by said voltage applying means is an alternating electric field.

4. An apparatus as claimed in claim 1, wherein the movement of the developer is controlled such that said developer is transferred and retransferred between said developer carrier and said image carrier in said developing region.

5. An apparatus as claimed in claim 1, wherein said developer carrier and said image carrier are moved relative to each other.

6. An apparatus as claimed in claim 1, wherein the surface of said developer carrier and the surface of said image carrier are spaced apart by a gap which is smaller than the thickness of the developer deposited in a layer on said developer carrier.

7. An apparatus as claimed in claim 1, wherein the surface of said developer carrier and the surface of said image carrier are spaced apart by a gap which is greater than the thickness of the developer deposited in a layer on said developer carrier.

8. A method of developing a latent image electrostatically formed on an image carrier by a developer carried on a developer carrier in a developing region where said image carrier and said developer carrier face each other, said method comprising the steps of:

forming on the surface of said developer carrier first areas which comprise a plurality of recesses formed on a surface thereof, which holds an insulating material such that a mesh pattern is formed on the surface of the developer carrier by the plurality of recesses holding said insulating material and second areas comprising a plurality of conductive areas interposed between said recesses;

producing an electric field in said developing region by voltage applying means; and producing in said first areas an electric field for development which is different from an electric field in said second areas by said charge held by said first areas, a potential deposited on said image carrier, and said electric field produced by said voltage applying means.

9. A method as claimed in claim 8, wherein electric fields produced between said first areas and said second areas cause the developer to be deposited on said developer carrier.

10. A method as claimed in claim 8, wherein said electric field produced by said voltage applying means comprises an alternating electric field.

11. A method as claimed in claim 8, wherein the surface of said image carrier and the surface of said developer carrier are spaced apart by a gap which is greater than the thickness of the developer deposited in a layer on said developer carrier.

12. A method as claimed in claim 8, wherein the surface of said developer carrier is made up of insulating areas and conductive areas which constitute said first areas and said second areas, respectively.

13. A method as claimed in claim 12, wherein a charge is held in said insulating areas by friction.

14. A method as claimed in claim 8, wherein said image carrier and said developer carrier are moved relative to each other.

15. An apparatus as claimed in claim 1, wherein said first areas are positively charged by friction between said first areas and a toner supply roller.

16. An apparatus as claimed in claim 1, wherein said first areas cover at least half the surface area of said developer carrier.

17. An apparatus as claimed in claim 1, wherein said great number of electric fields comprise closed electric fields formed on the surface of said developer carrier which are defined by paths traveling from the first areas to the second areas.

18. An apparatus as claimed in claim 1, wherein said first areas charge said developer to a negative potential and said second areas discharge a toner supply roller in order to produce a balanced charge condition between said developer, said toner supply roller and said developer carrier.

19. An apparatus as claimed in claim 1, wherein a surface potential of said first areas is offset to a positive potential and said second areas have a surface potential equal to a voltage bias applied to said developer carrier.

20. A method as claimed in claim 8, wherein said first areas are positively charged by friction between said first areas and a toner supply roller.

21. A method as claimed in claim 8, wherein said first areas cover at least half the surface area of said developer carrier.

22. A method as claimed in claim 8, wherein said great number of electric fields comprise closed electric fields on the surface of said developer carrier and are defined by paths traveling from the first areas to the second areas.

23. A method as claimed in claim 8, wherein said first areas charge said developer to a negative potential and said second areas discharge a toner supply roller in order to produce a balanced charge condition between said developer, said toner supply roller and said developer carrier.

24. A method as claimed in claim 8, wherein a surface potential of said first areas is offset to a positive potential and said second areas have a surface potential equal to a voltage bias applied to said developer carrier.

25. A developing apparatus incorporated in image forming equipment and located to face an image carrier in a developing region for developing a latent image electrostatically formed on said image carrier by a developer, said apparatus comprising:

a developer carrier for carrying the developer thereon and developing the latent image formed on said image carrier by said developer in said developing region, said developer carrier having first areas comprising a plurality of recesses formed on a surface thereof, each of which holds an insulating material, and second areas comprising a plurality of conductive areas interposed between said recesses, and wherein a great number of closed electric fields are developed between charged insulating areas and the associated conductive areas on the surface of said developer carrier and wherein said insulating areas are charged by friction; and voltage applying means for producing an electric field in said developing region;

said developing apparatus controlling the movement of said developer from said developer carrier to said image carrier by an electric field which is determined by the relationships between a potential deposited on said image carrier, a potential deposited on said developer carrier, and said electric field produced by said voltage applying means.

26. A developing apparatus as claimed in claim 25, wherein a mesh pattern is formed on the surface of the developer carrier by the plurality of recesses holding said insulating material.

27. A method of developing a latent image electrostatically formed on an image carrier by a developer carried on a developer carrier in a developing region where said image carrier and said developer carrier face each other, said method comprising the steps of:

forming on the surface of said developer carrier first areas which comprise a plurality of recesses formed on a surface thereof, each of which holds an insulating material, and second areas comprising a plurality of conductive areas interposed between said recesses;

producing an electric field in said developing region by voltage applying means; and producing in said first areas an electric field for development which is different from an electric field in said second areas by said charge held by said first areas, a potential deposited on said image carrier, and said electric field produced by said voltage applying means.

28. A method as claimed in claim 27, wherein a mesh pattern is formed on the surface of the developer carrier by the plurality of recesses holding said insulating material.

* * * * *